US005858261A

United States Patent [19]

Muroi et al.

[11] Patent Number: 5,858,261

[45] Date of Patent: Jan. 12, 1999

[54] CONTINUOUS CASTING NOZZLE FOR CASTING MOLTEN STEEL

[75] Inventors: Toshiyuki Muroi, Gifu-ken; Kazumi Oguri, Mizunami, both of Japan

[73] Assignee: Akechi Ceramics Kabushiki Kaisha, Japan

[21] Appl. No.: 911,535

[22] Filed: Oct. 16, 1997

[30] Foreign Application Priority Data

Oct. 16, 1996 [JP] Japan ..... 8-295688
Dec. 5, 1996 [JP] Japan ..... 8-342598

[51] Int. Cl.[6] ..... B22D 35/00

[52] U.S. Cl. ..... 222/606; 501/108; 266/286

[58] Field of Search ..... 266/280, 286; 222/590, 591, 606, 607; 501/108, 84

[56] References Cited

U.S. PATENT DOCUMENTS 5,204,298 4/1993 Yaoi et al. ..... 501/108
5,482,904 1/1996 Kawabe et al. ..... 501/84

*Primary Examiner*—Scott Kastler
*Attorney, Agent, or Firm*—Thorp Reed & Armstrong

[57] ABSTRACT

The invention is related to a continuous casting nozzle for casting of aluminum killed steel without clogging of the bore of the nozzle. The surface layer of the bore of the continuous casting nozzle contacting with the molten steel is formed of a refractory comprising graphite from 10 to 35 wt % and roseki as the remaining part of the graphite, and the main component of the roseki is pyrophyllite ($Al_2O_3.4SiO_2.H_2O$) as mineral component. Further, silicon carbide from 1 to 10 wt % is contained in the refractory.

10 Claims, 1 Drawing Sheet

CONTINUOUS CASTING NOZZLE FOR CASTING MOLTEN STEEL

BACKGROUND OF THE INVENTION

1. Field of the Invention

The present invention relates to a continuous casting nozzle for permitting effective prevention of narrowing or clogging of the nozzle bore through which molten steel passes in performing continuous casting of the molten steel containing aluminum such as aluminum-killed steel which steel deoxidized with aluminum.

2. Description of the Related Art

A continuous casting nozzle for casting molten steel is used for the following purposes. As for continuous casting molten steel, a continuous casting nozzle is used for the purpose of preventing the molten steel and from being oxidized by contacting the open air, from splashing when the molten steel is poured from a tundish to a mold, and rectifying the flow of the molten steel poured for preventing non-metallic inclusion and slag present near or on the mold surface from being entrapped in the cast steel strand.

Material of a conventional continuous casting nozzle of molten steel comprises such material as graphite, alumina, silica, and silicon carbide. However, there are following problems in the case of casting aluminum-killed steel and the like.

As for the aluminum-killed steel and the like, aluminum, which is added as a de-oxidizer, reacts with oxygen existing in the molten steel to produce non-metallic inclusion such as alumina. Therefore, in casting the aluminum-killed steel and the like, the non-metallic inclusion such as the alumina adheres and accumulates onto the surface of the bore of the continuous casting nozzle, so that the bore is narrowed or clogged up in the worst case, which makes stable casting difficult. Furthermore, the non-metallic inclusion such as the alumina adhered or accumulated onto the surface of the bore peels off or falls down, and is entrapped in the cast steel strand, thus degrading the quality of the cast steel strand.

For the purpose of preventing the above-mentioned reduction or clogging of the bore caused by the non-metallic inclusion such as alumina, there is a commonly used method for preventing the non-metallic inclusion such as alumina existing in the molten steel from adhering or accumulating onto the surface of the bore of the nozzle by ejecting inert gas from the inner surface of the nozzle bore toward the molten steel flowing through the bore. One example of this method is described in Japanese Patent Publication No. Hei 6-59533/1994.

However, the method wherein the inert gas is ejected from the inner surface of the nozzle forming the bore has the following problem. A large amount of the ejected inert gas causes entrapment of bubbles produced by the inert gas into the cast steel strand, resulting in defects based on needle-like gas bubbles or pinholes. On the other hand, a small amount of the ejected inert gas causes adhesion and accumulation of the non-metallic inclusion such as the alumina onto the surface of the bore of the nozzle, thus causing narrowing or clogging, in the worst case, of the bore.

Additionally, it is constructionally difficult to uniformly eject the inert gas from the inner surface of the nozzle bore toward the molten steel flowing through the bore. In the instance where the casting is performed for a long period of time, a stable control of the amount of ejected inert gas becomes gradually more difficult, as the structure and the structure of the material consisting of the continuous casting nozzle degrades. As a result, the non-metallic inclusion such as the alumina adheres and accumulates onto the surface of the bore of the nozzle so that the bore is narrowed or clogged at the end.

It is thought that the clogging of the nozzle by the non-metallic inclusion, especially by the alumina inclusion, is caused as described below.

(1) Alumina inclusion is produced from aluminum existing in the steel by secondary oxidation, such as oxidation by entrapped air passing through a refractory junction and refractory structure or oxidation by supplying oxygen obtained from reduction of silica in a carbon-containing refractory.

(2) Alumina inclusion is produced by diffusion and cohesion of the alumina produced in the above process.

(3) Carbon on the surface of the nozzle bore vanishes and the surface of the bore becomes rough and the alumina inclusion is apt to accumulate on the rough surface of the bore.

On the other hand, as an alternative in view of the nozzle material, a nozzle having a non-oxide raw material (SiC, $Si_3N_4$, BN, $ZrB_2$, SIALON, etc.) with low reactivity with aluminum oxide is added to alumina-graphite nozzle consisting of the non-oxide material itself is proposed. An example of this alternative is described in Japanese Patent Publication No. Sho 61-38158/1986.

However, this alternative is not practical in the case of the alumina-graphite nozzle, because the adhesion preventing effect is not recognized and further corrosion resistance is decreased unless a large amount of the non-oxide material is added.

Also, a nozzle only consisting of the non-oxide material is not suitable for practical use in view of material cost and manufacturing cost, although a substantial effect is expected.

A nozzle consisting of graphite-oxide raw material containing CaO is proposed for producing low-melting-point material by a reaction of CaO in an oxide raw material containing CaO ($CaO.ZrO_2$, $CaO.SiO_2$, $2CaO.SiO_2$, etc.) with $Al_2O_3$ and forming the low-melting-point material in the steel. An example of this type of nozzle is described in Japanese Patent Laid-Open Publication No. Sho 62-56101.

However, reactivity of CaO with $Al_2O_3$ is apt to be influenced by the temperature of the molten steel when casting, and in one instance, the amount of CaO is not sufficiently secured for satisfying spalling resistance and corrosion resistance when a sufficient amount of $Al_2O_3$ inclusion is contained in the steel.

SUMMARY OF THE INVENTION

The present invention provides a continuous casting nozzle having the following features.

(1) A glass layer is formed at the surface of the bore of the nozzle when the nozzle is used, thereby preventing air from being entrapped through refractory structure, which prevents alumina from being produced.

(2) Prevention of erosion by products having a low-melting-point on account of a reaction between an aggregate in a refractory and alumina in the steel and by smoothing the bore surface of the nozzle without the use of a mechanical means such as the ejecting of an inert gas.

(3) A continuous casting nozzle which is able to prevent the bore from narrowing or clogging economically, comparatively easy and stably.

In the present invention, the surface layer of the bore of a continuous casting nozzle contacting with molten steel is formed of a refractory comprising graphite from 10 to 35 wt % and roseki as the remaining refractory wherein the main component of the roseki is pyrophyllite ($Al_2O_3.4SiO_2.H_2O$), a mineral composition.

Concretely, the surface layer of the bore of a continuous casting nozzle contacting with molten steel is formed of a refractory comprising graphite from 10 to 35 wt % and roseki as the remaining part of the refractory, and the main component of the roseki is pyrophyllite ($Al_2O_3.4SiO_2.H_2O$), a mineral composition, wherein binder is added to the refractory, the refractory is kneaded, formed, and baked in the anti-oxidizing atmosphere.

It is preferred that the roseki containing the pyrophyllite as the main component is calcinated at a temperature equal to or greater than 800° C. so as to vanish crystal water and contain alkaline component from 1 to 5 wt %.

It is preferred that the roseki containing the pyrophyllite as the main component, contains a mixing weight ratio of roseki of an average grain diameter equal to or less than 250 μm is equal to or less than 60% relative to the whole of the roseki content so as to form a glass layer at the surface contacting with the molten steel.

In the present invention, it is also preferred that the surface layer of the bore of a continuous casting nozzle contacting with the molten steel is formed of a material comprising graphite from 10 to 35 wt %, silicon carbide from 1 to 10 wt % and roseki as the remaining part of the material and the silicon carbide, and the main component of the roseki is pyrophyllite wherein binder is added to the refractory, the refractory is kneaded, formed, and baked in the anti-oxidizing atmosphere.

It is further preferred that the roseki containing the pyrophyllite as the main component is calcinated at a temperature equal to or more than 800° C. so as to vanish crystal water and contains an alkaline component from 1 to 5 wt %.

It is preferred that the roseki containing the pyrophyllite as the main component contains a mixing weight ratio of roseki with an average grain diameter equal to or less than 250 μm is equal to or less than 60% relative to the whole of the roseki content.

DETAILED DESCRIPTION OF THE PREFERRED EMBODIMENTS OF THE INVENTION

Figure 1:
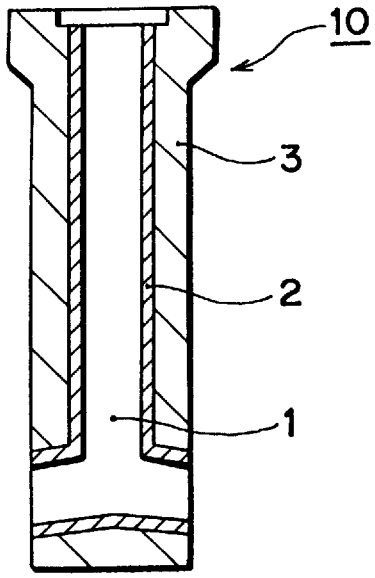
FIG. 1 shows a cross section of a nozzle according to the present invention comprising a refractory at the surface layer of the bore of the nozzle contacting with molten steel.

A major characteristic of a continuous casting nozzle of the present invention is that the main component of the surface layer of the bore of a refractory is roseki. When silica coexisting with graphite contacts molten steel containing aluminum, the following reactions usually occur.

$SiO_2$ (S)+C (S)=SiO (g)+CO (g)

3SiO(g)+2Al=$Al_2O_3$(S)+3Si

3CO(g)+2Al=$Al_2O_3$ (S)+3C

As shown in the above reactions, decomposition of the silica produces SiO(g) and CO(g), which react with aluminum in the steel to form $Al_2O_3$, thereby providing an oxygen supply source for the steel. However, as for the roseki, the roseki particles do not decompose even if it coexists with graphite, namely $SiO_2$ in pyrophyllite ($Al_2O_3.4SiO_2.H_2O$) which is the main mineral of the roseki and is stable. This results is based on the fact that the particles do not decay and bubbles are not produced, by means of a microscope observation after forming a briquette consisting of the roseki, resin powders and carbon powders and performing heat-treatment at a temperature of 1500° C. for 24 hours while burying it in a coke breeze.

The half-melting temperature of the roseki is about 1500° C., so that it melts at the working surface contacting with the molten steel to form a glass coat for smoothing the structure of the surface of the bore and preventing air from being entrapped through a refractory structure. This is based on the fact that the permeability is decreased such that the permeability after performing heat-treatment at a temperature of 1500° C. for 1 hours is as small as $95\times10^{-5}$ darcy, in contrast with the permeability after performing heat-treatment at a temperature of 1000° C. for 1 hours is $95\times10^{-4}$ darcy.

To actively form the glass coat on the surface of the bore used as a continuous casting nozzle, preferably, a mixing weight ratio of the roseki is equal to or greater than 65 wt %. Also, it is preferred that the mixing weight ratio of the roseki is equal to or less than 90 wt %, because the degree of softening deformation is large within a range of over 90 wt %.

To prevent softening deformation and to maintain heat-impact resistance of the roseki a mixing weight ratio of the graphite equal to or greater than 10 wt % is preferred. Also, it is preferred that the mixing weight ratio of the graphite is equal to or less than 35 wt % from the view point of manufacturing of the nozzle, because the volume ratio of the graphite relative to the roseki is too large resulting in structural defects such as lamination being produced in the range of over 35 wt %. Considering thermal conductivity and oxidation resistance, natural graphite is suitable as the graphite to be mixed.

To actively cause a bloating phenomenon in sintering of the roseki, it is preferable that a mixing ratio of the silicon carbide is equal to or greater than 1 wt % and the mixing ratio of the silicon carbide should be equal to or less than 10 wt %, because erosion is too large in the range of over 10 wt %.

The reason for using the roseki calcinated at a temperature equal to or greater than 800° C. to vanish crystal water is that the crystal water is released from the roseki at a temperature in a range of from 500° to 800° C. in sintering and the refractory cracks by virtue of an unusually large coefficient of thermal expansion in this range.

It is preferred that a mixing weight ratio of roseki with an average grain diameter equal to or less than 250 μm is equal to or less than 60% relative to the whole of the roseki content, because, in the range of over 60%, structure defects such as lamination are apt to be produced in molding and softening deformation of roseki particles is apt to happen when used in a continuous casting nozzle.

The present invention provides for the use of three kinds of roseki, that is pyrophyllite matter roseki, kaolin matter roseki, and sericite matter roseki. The pyrophyllite matter roseki with refractoriness from SK29 to SK32 is suitable considering formation of a glass layer and erosion resistance against the molten steel as the surface of the bore contacting with the molten steel is half-molten in use, wherein SK is a Japanese Standard for refractoriness. Both of the kaolin matter roseki and the sericite matter roseki is less preferred, because the kaolin matter roseki has a greater refractoriness from SK33 to SK36, and the sericite matter roseki has a smaller refractoriness from SK26 to SK29.

The refractory structure comprises graphite from 10 to 35 wt % and roseki from 65 to 90 wt % as the remaining part of the refractory, the main component which is pyrophyllite ($Al_2O_3.4SiO_2.H_2O$), particles of the roseki are not decomposed and it does not become an oxygen supplying source into the steel not as $SiO_2$ even if it coexists with the graphite. Also, adhesion of $Al_2O_3$ and metal is prevented, because a half-melting temperature of the roseki is about 1500° C. near a casting temperature of the molten steel, allowing a glass coat layer to form at a working surface contacting with the molten steel, which smoothes the working surface structure and prevents air from being entrapped and diffused through the refractory structure.

The continuous casting nozzle for steel according to the present invention will be described in detail with reference to the accompanying drawings.

FIG. 1 shows an embodiment of a longitudinal sectional view of the immersion nozzle according to the present invention. The nozzle 10 is placed between a tundish and a mold, and used as an immersed nozzle for pouring the molten steel from the tundish to the mold. As shown in FIG. 1, a surface layer 2 of the bore 1, through which the molten steel flows, of the continuous casting nozzle 10 consists of a refractory having the chemical composition as above described. The remaining part of the nozzle 3 is composed of regular refractory, for example, of alumina-graphite. The dimensions of the nozzle are about 1 m in total length, about 6 cm in bore diameter, 16 cm in outer diameter, and about 5 cm in thickness. And, the thickness of the surface layer of the bore made of the refractory in connection with the present invention is from about 2 mm to about 15 mm.

Figure 2:
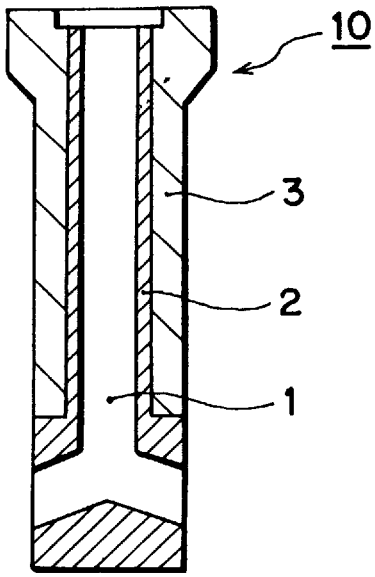
FIG. 2 shows cross section of a nozzle according to the present invention comprising a refractory at the surface layer of the bore of the nozzle and the lower part (a part immersed in the molten steel) of the nozzle.

FIG. 2 shows another embodiment of a nozzle, in which the whole part of the mold immersed in the molten steel is formed of a refractory according to the present invention. Alumina usually aggregates at the lower part of the nozzle bore and makes the stable flow of molten steel difficult. The immersed nozzle according to the present invention prevents adhesion or accumulation of non-metallic inclusion such as the alumina in the molten steel onto the surface layer 2.

The present invention is further described by means of the following examples.

EXAMPLE 1

8 mixed materials with different composition were prepared and phenol resin in the state of powder and liquid was added in an amount within a range of from 5 to 10 wt % to each of 8 mixed materials. From the 8 materials, the following formed bodies were prepared.

A first formed body (hereinafter referred to as the "formed body 1") with dimensions of 30 mm by 30 mm by 230 mm was prepared for examining an amount of adhesion of non-metallic inclusion such as alumina and corrosion resistance against the molten steel, a second formed body (hereinafter referred to as the "formed body 2") with dimensions of 50 mmϕ by 20 mm was prepared for examining permeability, and a third formed body (hereinafter referred to as the "formed body 3") with dimensions of 100 mm outer diameter, 60 mm inner diameter and 250 mm length was prepared for examining spalling resistance, and then the bodies were sintered in reduced atmosphere at a temperature range of from 1000° to 1200° C.

Samples Nos. 1 to 5 (hereinafter referred to as the "sample of the present invention") shown in Table 1 were prepared having the chemical compositions within the scope of the present invention and Samples Nos. 6 to 8 (hereinafter referred to as "sample for comparison") were prepared having chemical compositions out of the scope of the present invention.

Physical properties, porosity and bulk density, for each of the above-mentioned samples of the present invention Nos. 1 to 5 and the samples for comparison Nos. 6 to 8 are shown in Table 1.

The spalling resistance of each of the sintered formed bodies 3 of the samples of the present invention Nos. 1 to 5 and the samples for comparison Nos. 6 to 8 were examined after being heated at a temperature of 1500° C. for 30 minutes in an electric furnace and then rapidly cooling by water. The results are shown in Table 1.

An erosion ratio (%) and an amount of adhesion of non-metallic inclusion such as alumina of each of the sintered formed bodies 1 of the samples of the present invention Nos. 1 to 5 and the samples for comparison Nos. 6 to 8 were examined after being immersed in molten steel, which contains aluminum in a range from 0.02 to 0.05 wt %, at a temperature of 1550° C. for 180 minutes. The results are shown in Table 1.

The permeability for each of the sintered formed bodies 2 of the samples of the present invention Nos. 1 to 5 and the samples for comparison Nos. 6 to 8 was examined after heating at a temperature of 1500° C. for 60 minutes in an electric furnace and then cooling. The results are shown in Table 1.

It is easily understood from Table 1 that the samples of the present invention are superior in spalling resistance and non-metallic inclusion such as alumina does not adhere in spite of the low erosion ratio, thereby effectively preventing reduction or clogging of the continuous casting nozzle of the molten steel.

Also, it is possible for the samples of the present invention to prevent air from being entrapped through the refractory in use because of small permeability.

On the other hand, it is obvious that the sample for comparison No. 6 is remarkably inferior in spalling resistance and the corrosion resistance against the molten steel, although a small amount of alumina adheres due to much of the roseki content.

As for the sample for comparison No. 7, the amount of adhesion of alumina is remarkably large, because it contains $Al_2O_3$ and $SiO_2$, which decomposes to supply oxygen in the steel, instead of the roseki.

As for the sample for comparison No. 8, a large amount of non-metallic inclusion such as alumina adheres and the permeability is large, although a mineral for supplying oxygen into the steel is eliminated, in other words it does not contain $SiO_2$ instead of the roseki and only contains $Al_2O_3$.

EXAMPLE 2

This example is related to a nozzle made of refractory including silicon carbide in the first example of the present invention. Samples were prepared using the same process as in the first example. Phenolic resin in the state of powder and liquid was added in an amount within a range of from 5 to 10 wt % to each of 8 mixed materials, and then the resultant raw materials obtained by mixing and kneading the above materials were sintered. From the 8 materials the following formed bodies were prepared.

A first formed body (hereinafter referred to as the "formed body 1") with dimensions of 30 mm by 30 mm by 230 mm was prepared for examining an amount of adhesion of non-metallic inclusion such as alumina and corrosion resistance against the molten steel, a second formed body (hereinafter referred to as the "formed body 2") with dimensions of 50 mmϕ by 20 mm was prepared for examining permeability, and a third formed body (hereinafter referred to as the "formed body 3") with dimensions of 100 mm in outer diameter, 60 mm in inner diameter and 250 mm in length was prepared for examining spalling resistance and then the bodies were sintered in reduced atmosphere at a temperature range from 1000° to 1200° C.

Samples Nos. 1 to 5 (hereinafter referred to as the "sample of the present invention") shown in Table 1 were prepared having the chemical compositions within the scope of the present invention and Samples Nos. 6 to 8 (hereinafter referred to as "sample for comparison") were prepared having chemical compositions out of the scope of the present invention.

Physical properties, porosity and bulk density, for each of the above-mentioned samples of the present invention Nos. 1 to 5 and the samples for comparison Nos. 6 to 8 are shown in Table 2.

The spalling resistance of each of the sintered formed bodies 3 of the samples of the present invention Nos. 1 to 5 and the samples for comparison Nos. 6 to 8 was examined after being heated at a temperature of 1500° C. for 30 minutes in an electric furnace and then rapidly cooling by water. The results are shown in Table 2.

An erosion ratio (%) and an amount of adhesion of non-metallic inclusion such as alumina of each of the sintered formed bodies 1 of the samples of the present invention Nos. 1 to 5 and the samples for comparison Nos. 6 to 8 were examined after immersing in molten steel, which contains aluminum in a range from 0.02 to 0.05 wt %, at a temperature of 1550° C. for 180 minutes. The results are shown in Table 2.

The permeability for each of the formed bodies B of the samples of the present invention Nos. 1 to 5 and the samples for comparison Nos. 6 to 8 was examined after heating at a temperature of 1500° C. for 60 minutes in an electric furnace and then cooling.

It can be seen from Table 2 that the samples of the present invention are superior in the spalling resistance and the non-metallic inclusion such as alumina do not adhere in spite of the low erosion ratio, thereby effectively preventing reduction or clogging of the nozzle of the molten steel. Also, it is possible for the samples of the present invention to prevent air from being entrapped through the refractory in use because of small permeability.

On the other hand, it is obvious that the sample for comparison No. 6 is remarkably inferior in the spalling resistance and the corrosion resistance against the molten steel, although a small amount of alumina adheres due to much roseki content.

As for the sample for comparison No. 7, the amount of adhesion of alumina and the permeability is large, because silicon carbide is not added. As for the sample for comparison No. 8, it is apparent that the corrosion resistance against the molten is remarkably inferior, because a large amount of silicon carbide is added.

Therefore, according to the continuous casting nozzle of molten steel of the present invention, it is possible to perform stable casting while preventing reduction or clogging of the bore usually caused by the non-metallic inclusion such as alumina without deterioration of the refractory structure.

According to the present invention, approximately 600 to 800 ton of a low carbon aluminum killed steel (C: 0.04%, Mn:0.33%, Al:0.051%) is continuously cast with one nozzle without clogging by two strand slab caster which is a slab caster equipped with two molds for casting two strands simultaneously.

Meanwhile, 360~480 tons of the same low carbon aluminum killed steel was continuously cast with one nozzle of conventional alumina-graphite without clogging by the same caster.

TABLE 1

| | | Sample No. of the Present Invention | | | | | Sample No. for Comparison | | |
|---|---|---|---|---|---|---|---|---|---|
| | | 1 | 2 | 3 | 4 | 5 | 6 | 7 | 8 |
| Mixing Composition (wt %) | Graphite | 10 | 15 | 25 | 30 | 35 | 5 | 25 | 25 |
| | Roseki (0.5–1 mm) | 36 | 35 | 30 | 30 | 26 | 38 | — | — |
| | Roseki (−0.25 mm) | 54 | 40 | 45 | 40 | 39 | 57 | — | — |
| | $Al_2O_3$ | | | | | | | 50 | 70 |
| | $SiO_2$ | | | | | | | 25 | |
| Physical Properties | Porosity (%) | 13.5 | 13.8 | 14.3 | 15.8 | 16.5 | 13.0 | 12.8 | 16.4 |
| | Bulk density | 2.18 | 2.15 | 2.12 | 2.08 | 2.00 | 2.20 | 2.30 | 2.56 |
| | Modulus of Rupture (MPa) | 8.1 | 7.8 | 7.6 | 7.0 | 6.5 | 8.5 | 12.1 | 8.0 |
| | Resistance to Molten Steel | 13 | 10 | 8 | 7 | 6 | 25 | 3 | 1 |
| | Permeability ($\times 10^{-4}$ darcy) after Heat-treatment 1500° C.-1 hr | 3.5 | 6.8 | 9.5 | 9.8 | 10.0 | 3.0 | 65 | 95 |
| | Spalling Resistance | No crack | No crack | No crack | No crack | No crack | Crack occurrence | No crack | Crack occurrence |
| | Amount of Adhesion of Alumina* | ≈1 | ≈0 | ≈0 | ≈0 | ≈1 | 3 | 15 | 10 |

*Number means comparative amount of aggregated alumina.

TABLE 2

| | | Sample No. of the Present Invention | | | | | Sample No. for Comparison | | |
|---|---|---|---|---|---|---|---|---|---|
| | | 1 | 2 | 3 | 4 | 5 | 6 | 7 | 8 |
| Mixing Composition (wt %) | Graphite | 10 | 15 | 25 | 30 | 35 | 5 | 25 | 25 |
| | Roseki | 89 | 75 | 70 | 60 | 60 | 90 | 75 | 50 |
| | $Al_2O_3$ | | | | | | | | |
| | $SiO_2$ | | | | | | | | |
| | SiC | 1 | 10 | 5 | 10 | 5 | 5 | | 25 |

TABLE 2-continued

| | | Sample No. of the Present Invention | | | | | Sample No. for Comparison | | |
|---|---|---|---|---|---|---|---|---|---|
| | | 1 | 2 | 3 | 4 | 5 | 6 | 7 | 8 |
| Physical Properties | Porosity (%) | 13.5 | 13.7 | 14.3 | 15.7 | 15.1 | 12.9 | 14.3 | 16.4 |
| | Bulk Density | 2.18 | 2.16 | 2.15 | 2.08 | 2.09 | 2.19 | 2.12 | 2.03 |
| | Modulus of Rupture (MPa) | 8.2 | 7.7 | 8.1 | 8.5 | 7.9 | 8.4 | 7.0 | 6.7 |
| | Resistance to Molten Steel (%) | 13 | 11 | 9 | 8 | 7 | 23 | 8 | 31 |
| | Permeability ($\times 10^{-4}$ darcy) after Heat-treatment 1500° C.-1 hr | 2.5 | 1.8 | 2.5 | 2.8 | 5.5 | 9.8 | 9.5 | 12.5 |
| | Spalling Resistance | No crack | No crack | No crack | No crack | No crack | Crack occurrence | No crack | Crack occurrence |
| | Amount of Adhesion of Alumina* | ≈0.5 | ≈0 | ≈0 | ≈0 | ≈0 | 2 | ≈1 | 7 |

*Number means comparative amount of aggregated alumina.

We claim:

1. A continuous casting nozzle for casting molten steel, wherein the surface layer of the bore of said continuous casting nozzle contacting with the molten steel is formed of a refractory comprising graphite from 10 to 35 wt % and roseki as the remaining part of the refractory, and the main component of the roseki is pyrophyllite ($Al_2O_3.4SiO_2.H_2O$) as mineral component.

2. A continuous casting nozzle of molten steel, wherein the surface layer of the bore of the continuous casting nozzle contacting with the molten steel is formed of a refractory comprising graphite from 10 to 35 wt % and roseki as the remaining part of the refractory and the main component of the roseki is pyrophyllite ($Al_2O_3.4SiO_2.H_2O$), a mineral composition, binder is added to said refractory, said refractory is kneaded, formed, and sintered in the reducing atmosphere.

3. The continuous casting nozzle according to claim 1, wherein the roseki containing the pyrophyllite as the main component is calcinated at a temperature equal to or greater than 800° C. so as to vanish crystal water and contain alkaline component from 1 to 5 wt %.

4. The continuous casting nozzle according to claim 1, wherein a mixing weight ratio of roseki of an average grain diameter equal to or less than 250 $\mu$m in the roseki containing the pyrophyllite as the main component is equal to or less than 60% relative to the whole of the roseki content.

5. The continuous casting nozzle of molten steel according to claim 1, wherein in addition to the graphite and the roseki, silicon carbide from 1 to 10 wt % is contained in the refractory, said refractory being added binder, kneaded, formed, and sintered in the reducing atmosphere.

6. The continuous casting nozzle according to claim 5, wherein the roseki containing the pyrophyllite as the main component is calcinated at a temperature equal to or greater than 800° C. so as to vanish crystal water and contain alkaline component from 1 to 5 wt %.

7. The continuous casting nozzle according to claim 5, wherein a mixing weight ratio of roseki of an average grain diameter equal to or less than 250 $\mu$m in the roseki containing the pyrophyllite as the main component is equal to or less than 60% relative to the whole of the roseki content.

8. The continuous casting nozzle according to claim 2, wherein the roseki containing the pyrophyllite as the main component is calcinated at a temperature equal to or greater than 800° C. so as to vanish crystal water and contain alkaline component from 1 to 5 wt %.

9. The continuous casting nozzle according to claim 2, wherein a mixing weight ratio of roseki of an average grain diameter equal to or less than 250 $\mu$m in the roseki containing the pyrophyllite as the main component is equal to or less than 60% relative to the whole of the roseki content.

10. The continuous casting nozzle according to claim 6, wherein a mixing weight ratio of roseki of an average grain diameter equal to or less than 250 $\mu$m in the roseki containing the pyrophyllite as the main component is equal to or less than 60% relative to the whole of the roseki content.

* * * * *